United States Patent [19]

Rose

[11] 3,949,767

[45] Apr. 13, 1976

[54] MIRROR CASE

[75] Inventor: Arnold Rose, Providence, R.I.

[73] Assignee: Trina, Inc., Fall River, Mass.

[22] Filed: July 30, 1975

[21] Appl. No.: 600,421

[52] U.S. Cl. ..... 132/83 R
[51] Int. Cl.[2] ..... A45D 33/00
[58] Field of Search ..... 132/83 R, 83 E

[56] References Cited

UNITED STATES PATENTS

| | | | |
|---|---|---|---|
| 1,184,146 | 5/1916 | Sundh | 132/83 R |
| 1,632,864 | 6/1927 | Weber | 132/83 R |
| 2,503,163 | 4/1950 | Maddox | 132/83 E |
| 3,776,245 | 12/1973 | Hayes et al. | 132/83 R |

*Primary Examiner*—G. E. McNeill
*Attorney, Agent, or Firm*—Salter & Michaelson

[57] ABSTRACT

A combination support and case for make-up mirrors, comprising articulated parts mounting, respectively, a flat mirror and a magnifying mirror, said parts being designed to be disposed face-to-face to form a protective dust-tight chamber within which the surfaces of the mirrors are spaced from each other and being movable to a position at an angle to each other such that one supports the other in an upright and rearwardly inclined position for use.

16 Claims, 8 Drawing Figures

MIRROR CASE

SUMMARY AND BACKGROUND OF THE INVENTION

Make-up cases comprising articulated parts designed to provide support for a mirror and a receptacle for a quantity of powder are well known in the art. It is the purpose of this invention to provide a case of the foregoing kind wherein the parts are designed to provide support for two mirrors, one in each of the parts, instead of a mirror and powder, with the surfaces of the mirrors spaced apart and confined in an essentially dust-tight chamber between the parts when the latter are engaged and when the parts are rotated away from each other to provide supports for the mirrors for setting one or both of the mirrors in an upright rearwardly inclined position. As herein illustrated, the support and carrying case comprises two rigid parts, hinge means connecting the two parts for angular movement relative to each other about the axis of the hinge means on the one hand to dispose the parts parallel to each other with the face of one confronting the face of the other and on the other hand to dispose the parts at an angle to each other. The face of each part contains a recess for receiving a mirror so that when the parts are disposed face-to-face, the mirrors are confined between the parts with a space between their surfaces and when the parts are disposed at an angle to each other, one of the parts comprises a support for the other. The mirrors are, respectively, a plain mirror and a magnifying mirror. They have mutually engaged means marginally on the confronting faces of the parts which form a dust seal between the parts when disposed face-to-face, and there are mutually engaged latch elements at the distal ends of the parts for holding the parts together when disposed face-to-face. The parts may be disposed with one part in a horizontal position and the other inclined upwardly and rearwardly therefrom or may be rotated relative to each other to dispose the parts back-to-back at an acute angle relative to each other by means of which one part consitutes a support for supporting the other in an upwardly and rearwardly inclined position when the parts are placed on a horizontal supporting surface. At the proximal ends of the parts there are mutually engageable means for limiting the angular disposition of the parts with respect to each other. The hinge means comprise along the proximal edge of one part a cylindrical edge portion shorter in length than the width of the part and along the proximal edge of the other part spaced cylindrical edge portions spaced apart so as to receive between them the cylindrical edge portion of the one part. The cylindrical edge portions contain aligned holes, the axes of which lie in the plane of the confronting surfaces of the parts and are spaced from and parallel to the proximal ends, and there are pivot pins frictionally engaged with the holes. The pivot pins are hollow, longitudinally split and press fitted into the hole.

The invention will now be described in greater detail with reference to the accompanying drawings, wherein.

Figure 1:
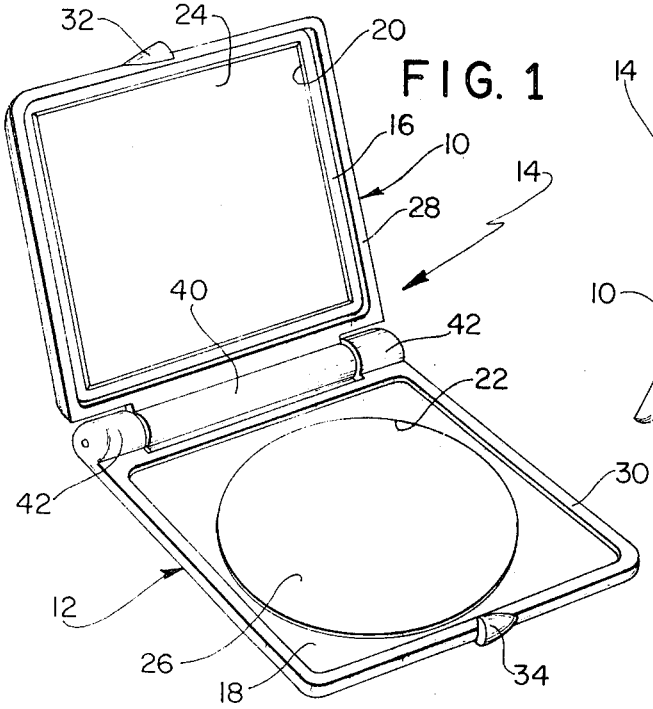
FIG. 1 is an isometric view of the combination support and case for make-up mirrors in an open position with one part resting on a horizontal surface and the other inclined upwardly and rearwardly therefrom.
Figure 2:
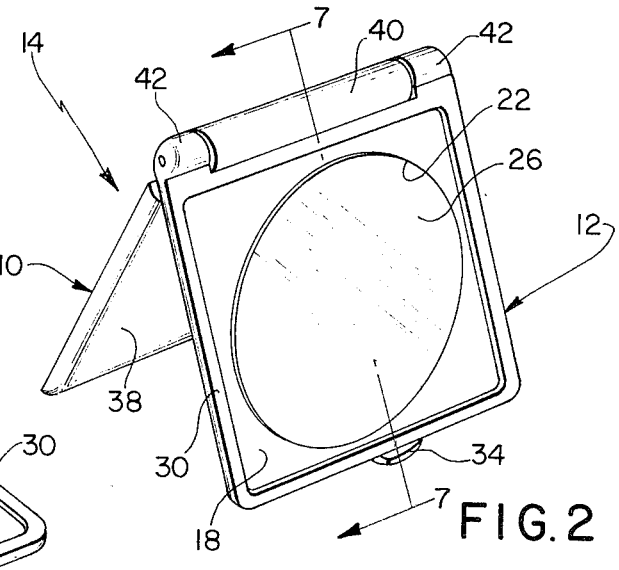
FIG. 2 is an isometric view of the combination support and case with the parts disposed back-to-back at an angle to each other such as to enable setting the parts on edge on a horizontal surface with the mirrors in upright rearwardly inclined positions.
Figure 8:
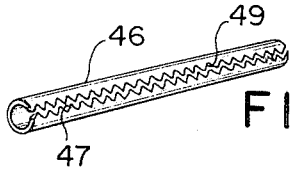
FIG. 8 is an isometric view of one of the hinge pins.
Figure 6:
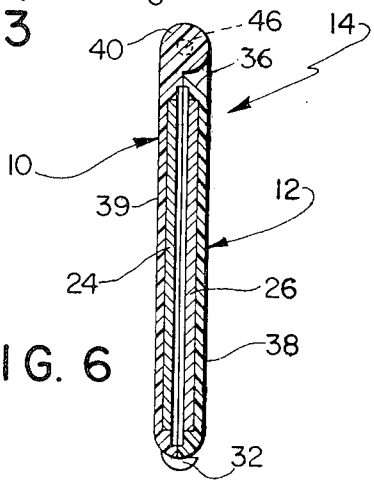
FIG. 6 is a section taken on line 6—6 of FIG. 3.
Figure 7:
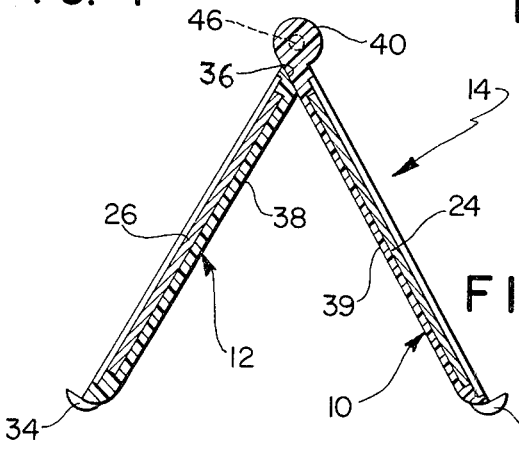
FIG. 7 is a section taken on line 7—7 of FIG. 2.

Referring to the drawings, the combination support and case for make-up mirrors as disclosed herein comprises two rigid parts 10 and 12 of substantially rectangular configuration connected along one edge by hinge means 14 so that the parts 10 and 12 may, on the one hand, be disposed parallel to each other, FIG. 6, with the face 16 of the part 10 confronting the face 18 of the part 12, and, on the other hand, may be disposed at an angle to each other as shown in FIG. 1 with the part 12 resting on a horizontal surface and the part 10 inclined upwardly and rearwardly therefrom or as shown in FIGS. 2 and 7 with the parts 10 and 12 disposed back-to-back at an angle to each other such that the faces 16 and 18 face away from each other.

Each of the parts 10 and 12 is provided with a recess 20, 22, respectively, for receiving a rectangular optical mirror 24 and a circular magnifying mirror 26 with their surfaces substantially flush with the surfaces of the confronting faces 16 and 18. The mirrors are preferably beveled at their peripheral edges and are secured in the recesses by means of a suitable adhesive.

Each of the parts 10 and 12 has peripherally thereof a narrow raised rib 28, 30, respectively, which has a uniformly flat surface so that when the parts are disposed face-to-face, the flat surfaces of the ribs 28, 30 collectively provide a seal peripherally of the parts against entrance of dust and/or moisture.

At the distal ends of the parts 10 and 12 there are, respectively, mutually engageable latch elements 32, 34 which by frictional engagement will hold the parts together when disposed face-to-face until manually forced apart.

Figure 3:
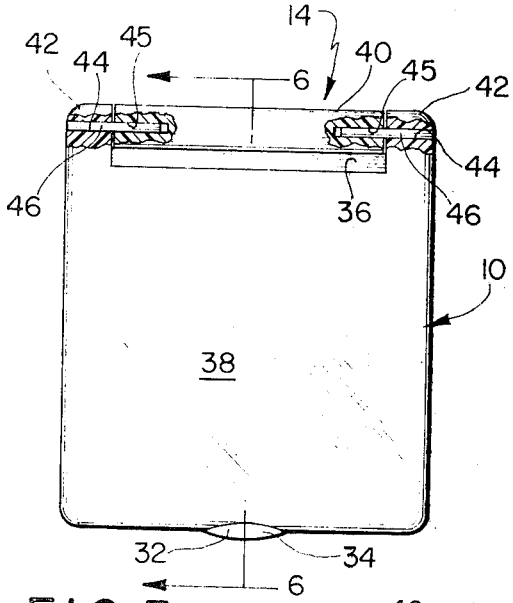
FIG. 3 is a plan view of the combination support and case closed as seen from one side with portions at the hinge means sectioned.

The parts 10 and 12 when disposed face-to-face provide a dust-tight case within which the mirrors are protectively contained with their surfaces out of contact with each other and when disposed at an angle to each other provide supports for the mirror. Thus, in use, the case may be opened up to one of two alternative positions, as shown in FIGS. 1 and 2. In the position shown in FIG. 1, the part 12 rests flat on a table or other support and the part 10 is lifted upwardly and rotated rearwardly to an upwardly and rearwardly inclined position and will remain in this position by reason of the frictional engagement provided in the hinge means 14, as will appear hereinafter. As shown in FIG. 2, the part 10 is rotated rearwardly through an angle greater than 180° to dispose it behind the part 12 at an acute angle thereto so that the mirrors 24 and 26 face away from each other. In this angular position of the parts, when the device is placed on a table, the lower edge of each part constitutes a support for the other part for supporting the two mirrors in upright rearwardly inclined positions for use. The angular disposition of the parts is chosen to provide for an optimum sight angle for a person seated at a table and is limited by engagement of an angular shoulder 36, FIGS. 3 and 7, at the proximal end of the part 10 and angular shoulders 37—37 at the proximal end of the part 12 with the back surfaces 38 and 39, respectively, of the parts 12 and 10.

Figure 4:
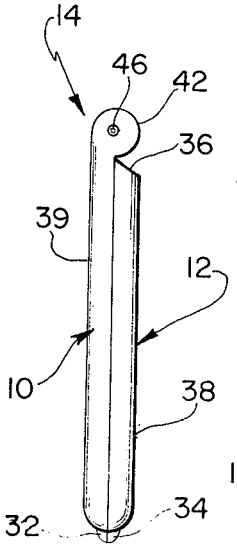
FIG. 4 is an edge view of the combination support and case.
Figure 5:
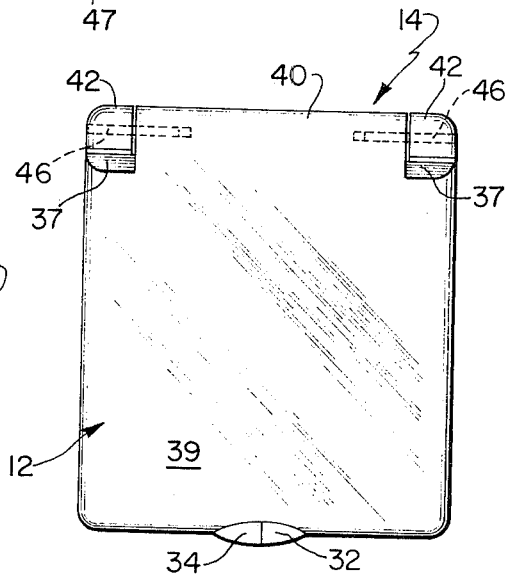
FIG. 5 is a plan view similar to FIG. 3 as seen from the opposite side.

The hinge means 14 is designed to provide sufficient friction so that there will be resistance to rotation of the parts 10 and 12 relative to each other, and hence so that one part can be disposed at an angle to the other and will remain in a given angular position without other support. As herein illustrated, the hinge means comprises a portion 40 at the proximal edge of the part 12 which is shorter in length than the width of the part 12 and two spaced portions 42—42 at the proximal edge of the part 10 which are spaced apart sufficiently to receive between them the portion 40. As shown in FIGS. 4, 6 and 7, the portions 40 and 42—42 comprise cylindrical extensions at the proximal edges of the parts, the axes of which lie in the plane of the confronting faces of the parts and which are of a diameter corresponding to the combined thickness of the parts. The cylindrical extensions contain holes 44—44, and the cylindrical extension 40 contains holes 45—45 for receiving hollow pivot pins 46—46 which are inserted through the holes 44—44 and driven with a forced fit into the holes 45—45. The pivot pins 46 are hollow sleeves containing lengthwise thereof a slot 47 having serrations 49 along its edges. The pivot pins are made of such diameter that they must be contracted slightly to be inserted through the holes 44—44 so that when released they will provide for frictional engagement with the holes 42—42 so as to resist rotation of the parts 10 and 12 relative to each other and thus to enable disposing the parts at any given angle relative to each other without other support. In addition, the hinge means as just described restrict and minimize entry of dust through the hinge area, since the only possible area where dust can enter is the relatively narrow spaces between portion 40 and portions 42—42.

The parts of the mirror are comprised of a suitable rigid plastic and are designed so as to be easily manufactured by conventional injection molding processes.

The device as thus described is of very simple construction, durable made, dust tight and capable of being used to advantage in that it enables setting the mirrors up in various positions and at various angles for use. Also, because the case is designed for injuction molding, it may be easily provided with surface decorations of attractive design.

It should be understood that the present disclosure is for the purpose of illustration only and includes all modifications or improvements which fall within the scope of the appended claims.

What is claimed is:

1. A combination support and case for make-up mirrors, comprising two rigid parts, hinge means connecting the two parts for angular movement relative to each other about the axis of the hinge means on the one hand to dispose the parts parallel to each other with a face of one confronting the face of the other and on the other hand to dispose the parts at an angle to each other, said confronting faces each containing a recess and a mirror fixed to the part within the recess such that when the parts are disposed face-to-face they constitute a case within which the mirrors are protectively contained with a space between their opposed surfaces and when the parts are disposed at an angle to each other each comprises a support supporting the other part and the mirror mounted thereon at an angle thereto.

2. A combination support and case according to claim 1, wherein the hinge means permits rotation of the parts comprising the case relative to each other from a position in which the parts are parallel to each other to a position in which one of the parts slopes upwardly from the plane of the other of the parts at a rearwardly inclined obtuse angle to the other part.

3. A combination support and case according to claim 1, wherein the hinge means permits rotating the parts comprising the case relative to each other from a position in which the parts are parallel to each other to a position in which the parts are disposed back-to-back at an actue angle to each other such that the distal ends of the parts provide supports sustaining the parts in upright rearwardly inclined positions.

4. A combination support and case according to claim 1, wherein the mirrors are, respectively, a plain mirror and a magnifying mirror.

5. A combination support and case according to claim 1, wherein there are mutually engageable means marginally of the recesses in the confronting faces of the parts which form a dust shield between the parts when disposed face-to-face.

6. A combination support and case according to claim 1, wherein there are mutually engageable latch elements at the distal ends of the parts for holding the parts together when disposed face-to-face.

7. A combination support and case according to claim 1, wherein the hinge means comprises at the proximal ends of the parts transversely aligned interengaged cylindrical edge portions, the axes of which lie along a straight line in the plane of the opposed faces and pivot pins frictionally engaged with the adjacent ends of the cylindrical edge portions.

8. A combination support and case according to claim 1, wherein one part has along its proximal end a cylindrical edge portion which is shorter than the part is wide and the axis of which lies in the plane of the face of the part and the other part has two cylindrical edge portions axially spaced apart a distance corresponding to the length of the cylindrical hinge portion of the one part, said two cylindrical portions of said other part being adapted to receive between them the cylindrical edge portion of the one part and said cylindrical edge portions collectively extending across the entire width of the parts and pivot pins extending from the ends of the two cylindrical edge portions into the ends of the edge portion of the one part.

9. A combination support and case according to claim 8, wherein the cylindrical edge portions contain aligned holes and wherein the pivot pins are frictionally engaged within the holes.

10. A combination support and case according to claim 7, wherein the pivot pins are hollow.

11. A combination support and case according to claim 10, wherein the pivot pins are hollow sleeves split longitudinally and press fitted into holes in said cylindrical edge portions.

12. A combination support and case according to claim 11, wherein the pivot pins are hollow sleeves containing longitudinally extending serrated slots and are press fitted into the cylindrical edge portions.

13. A combination support and case according to claim 1, wherein there are inclined shoulders at the proximal ends of the parts operable by engagement with the backs of the parts at their proximal ends which limit the angular disposition of the parts relative to each other.

14. A combination support and case according to claim 1, wherein there are inclined shoulders at the proximal end of one part at each end of the cylindrical portion and an inclined shoulder at the proximal end of the other part extending from one cylindrical portion to the other and wherein the inclined shoulders are operable by engagement with the back sides of the parts at the proximal ends to limit the angle of disposition of the parts relative to each other.

15. A combination support and case for make-up mirrors, comprising two rigid rectangular parts, hinge means connecting the parts alone one end so that one the one hand the parts may be disposed parallel to each other with the face of one confronting the face of the other and, on the other hand, the parts may be disposed at an angle to each other, and a flat rim bounding the entire edge at the face of each part such that when the parts are disposed face-to-face with the rims engaged there will be a space between the parts for receiving mirrors mounted to the faces with the surfaces of the mirrors out of contact, said rims collectively forming a seal peripherally of the space within which are mounted the mirrors, and said hinge means comprising interengaged extensions at the proximal ends of the parts containing alinged holes, the axes of which lie in the plane of the faces of the parts and which are spaced from and parallel to the proximal ends of the parts, and pivot pins frictionally engaged within said holes.

16. A combination support and case according to claim 15, wherein there is a recess in the face of each part within the bounding rim for receiving a mirror with its surface substantially in the plane of the face of the part below the plane of the bounding rim.

* * * * *